US006209147B1

(12) United States Patent
Wheaton

(10) Patent No.: US 6,209,147 B1
(45) Date of Patent: Apr. 3, 2001

(54) UNDERWATER ATTACHMENT SYSTEM

(76) Inventor: Michael David Wheaton, 8712 Summer Point Dr., Elk Grove, CA (US) 95624

( * ) Notice: Subject to any disclaimer, the term of this patent is extended or adjusted under 35 U.S.C. 154(b) by 0 days.

(21) Appl. No.: 09/224,418

(22) Filed: Dec. 31, 1998

(51) Int. Cl.[7] ..... E04H 4/00
(52) U.S. Cl. ..... 4/496; 248/534
(58) Field of Search ..... 248/501, 519, 248/530, 534, 154, 156; 4/495, 538, 680, 686, 695, 496, 494, 506; 108/42, 50.12, 150; 473/466, 479, 480, 481, 482, 483, 484, 485, 486, 487, 488, 489, FOR 100, FOR 101; 297/174, 173; 52/296, 297, 298, 109.7, 704; 403/349

(56) References Cited

U.S. PATENT DOCUMENTS 3,796,273 * 3/1974 Rininger ..... 175/7
4,353,659 * 10/1982 Comte ..... 403/24
4,539,629 * 9/1985 Poppenheimer ..... 362/267
4,776,046 * 10/1988 Newberry et al. ..... 4/541
5,040,251 * 8/1991 Hanford ..... 4/496
5,316,315 * 5/1994 Roark, Jr. ..... 273/411
5,383,644 * 1/1995 Huse ..... 248/523
5,465,677 * 11/1995 Alter ..... 114/230
5,860,171 * 1/1999 Hicks ..... 4/496

* cited by examiner

*Primary Examiner*—Steven O. Douglas
*Assistant Examiner*—Peter deVore
(74) *Attorney, Agent, or Firm*—Risto A. Rinne, Jr.

(57) ABSTRACT

A system for attaching accessories to a base structure that is disposed underwater in pools, spas, hot tubs and the like is described as including an upright pedestal support assembly that is detachably-attachable with respect to the base by a twist-lock "bayonet" type of a mounting system. This permits the pedestal support assembly to be attached to the base and removed therefrom as desired. The base structure remains permanently attached to the surrounding structures that are disposed underwater at the bottom or sides thereof. The surrounding structures are often formed of gunite. The base includes methods of anchoring it in place and of reinforcing it to the surrounding structures. Various devices are described that attach to the pedestal support assembly and include tables, umbrellas, stools, benches, basketball hoops and backboards, thermometers, and the like. Some of these devices are detachably-attachable to the same pedestal support assembly while others require their own pedestal support assembly. Together an underwater attachment system is described that enhances enjoyment and utility of aquatic areas.

22 Claims, 5 Drawing Sheets

UNDERWATER ATTACHMENT SYSTEM

BACKGROUND OF THE INVENTION

1. Field of the Invention

The present invention, in general relates to swimming pool accessories and, more particularly, to a system for interchangeably attaching umbrellas, tables, stools, benches, games, and other accessories to a base structure that is disposed underwater.

When lounging in a swimming pool or a hot tub an umbrella that is attached underwater and which extends above the surface of the water would produce shade and is therefore, desirable. A table that is disposed above the water surface would also be useful for serving food and drinks and even for reading. A bench or stool that is slightly submerged upon which one could sit would similarly also be valuable. It would also be desirable to be able to attach a game, such as a pole supporting a backstop and hoop so that a type of basketball could be played while in the pool. The ability to detach any of the above accessories to provide an open aquatic area or to be able to substitute other accessories would also be especially desirable.

Accordingly there exists today a need for an underwater attachment system that includes a base underneath the water to which a variety of objects such as are mentioned hereinbefore and hereinafter are detachably-attachable.

Clearly, such a system would be useful and desirable.

2. Description of Prior Art

Underwater attachments for devices such as umbrellas or tables are, in general, known. However, these types of devices, once installed, are permanent. They do not permit removal of the umbrella or table for more open use of the area nor do they permit the interchange of other types of devices. For example, it is not possible to remove the umbrella and substitute in its place a basketball post.

While the structural arrangements of the above described devices, at first appearance, have similarities with the present invention, they differ in material respects. These differences, which will be described in more detail hereinafter, are essential for the effective use of the invention and which admit of the advantages that are not available with the prior devices.

OBJECTS AND SUMMARY OF THE INVENTION

It is an object of the present invention to provide an underwater attachment system that can be used with a swimming pool.

It is also an important object of the invention to provide an underwater attachment system that can be used with a hot tub.

Another object of the invention is to provide an underwater attachment system that includes a base disposed underneath the water that can receive and support an accessory that is attached thereto.

Still another object of the invention is to provide an underwater attachment system that includes a base adapted to detachably receive an accessory that is useful in an aquatic environment.

Still yet another object of the invention is to provide an underwater attachment system that can be used to attach a support pedestal to a base.

Yet another important object of the invention is to provide an underwater attachment system that includes a support pedestal, detachably attachable to an underwater base.

Still yet another important object of the invention is to provide an underwater attachment system that can provide a table.

One other important object of the invention is to provide an underwater attachment system that can provide an umbrella. one further important object of the invention is to provide an underwater attachment system that can provide a bench.

One still further important object of the invention is to provide an underwater attachment system that can provide a stool.

Yet one more important object of the invention is to provide an underwater attachment system that can provide a support for a game.

One still further especially important object of the invention is to provide an underwater attachment system that includes a base having a twist-on and twist-off type of a mounting system for attaching and detaching a support pedestal.

Briefly, an underwater attachment system for use in an aquatic environment that is constructed in accordance with the principles of the present invention has a base attached to a structure under the water with its top nearly flush with the top surface of the structure to which it is attached. The base includes a method to detachably-attach a support pedestal thereto. The support pedestal is adapted to provide support for a variety of devices that are attached thereto. For example, it can provide support for an umbrella (to provide shade) or for a table, or for both simultaneously. The support pedestal can also provide support for a stool to sit on or, when used in concert with at least one additional base, a bench. It can be used to support any desired device, including a variety of games. For example the support pedestal when attached to the base can be used to support a basketball hoop and backboard. As the support pedestal is detachable apart from the base, it can be removed to provide an open area or it can be replaced when desired by another support pedestal adapted to provide an alternative benefit. According to a preferred embodiment, the support pedestal is adapted to twist on or off from the base and uses a type of "bayonet" mounting system. The base is attached to the bottom of the structure and the pedestal support is detachably-attachable thereto or a modified base is attached to the side of the structure and a modified pedestal support is detachably-attachable thereto.

DETAILED DESCRIPTION OF THE INVENTION

Figure 1:
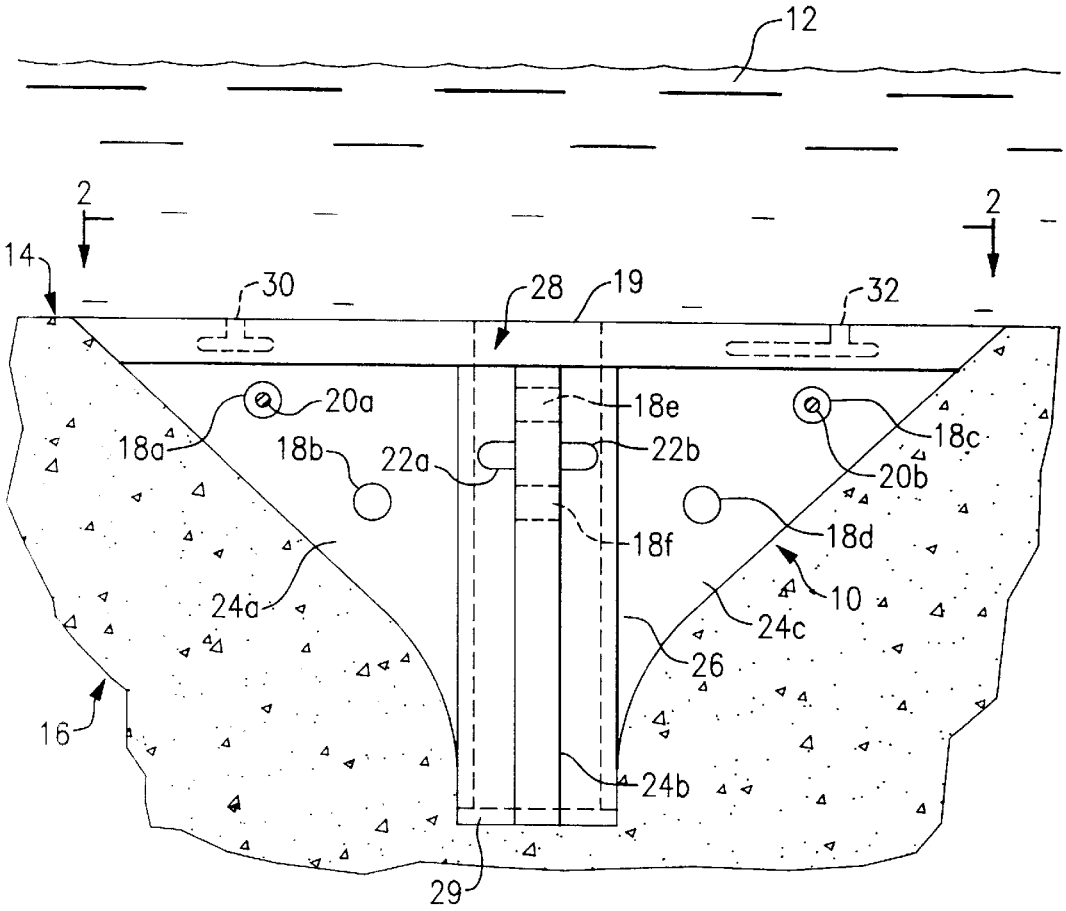
FIG. 1 is a side view of a base installed underwater.

Referring to FIG. 1 is shown, a base, identified in general by the reference numeral 10. Water 12 is above the base 10.

A surface 14, which forms the bottom of a pool, hot tub, or similar structure is disposed under the water 12 at a predetermined depth.

The surface 14 is typically the top of a structure that is formed of gunite, identified in general by the reference numeral 16. Gunite 16 is a type of air-blown concrete that is well known in the swimming pool construction arts and, as shown, surrounds the base 10.

The base 10 includes a plurality of holes 18 *a–f*. The holes 18 *a–f* are used to better secure the base 10 to the gunite 16 as during installation when the gunite 16 fills in certain of the holes 18*b*, 18*d*, 18*e*, and 18*f*, and which therefore better secures the base 10 to the gunite 16 when it is placed so that a top 19 is nearly flush with the surface 14. Two of the holes 18*a* and 18*c* have a reinforcing bar 20*a* and 20*b* passing through them and into the gunite 16. The reinforcing bars 20*a*, 20*b* are also useful in securing the base 10 in the proper position by fastening them to other reinforcing bars (not shown) that are dispersed throughout the area that is to be filled with the gunite 16.

Another way to better secure the base 10 to the gunite 16 is by the use of a plurality of protrusions 22*a* 22*b* that are formed as part of the base 10.

The base 10 includes the top 19, and a plurality of tapered members 24*a*, 24*b*, and 24*c* that are wider where they are attached to the top 19 and narrower at an opposite or bottom end. A fourth tapered member (not shown in this drawing) is disposed on the side opposite the second tapered member 24*b*.

A center cylindrical member 26 extends from the top 19 to the bottom of the tapered members 24 *a–c*. The tapered members 24 *a–c* are attached to the center cylindrical member 26 along its entire length. The tapered members 24 *a–c* each function as a gusset intermediate the center cylindrical member 26 and the top 19 and add strength to the overall assembly (as well as in helping to secure the base 10 to the surrounding gunite 16).

The center cylindrical member 26 includes a hollow interior 28 that extends from the top 19 to a bottom plate 29 that forms a seal at the bottom of the base 10.

A first arcuate slot 30 and a second arcuate slot 32 (a third arcuate slot is not shown in this drawing) are provided in the top 19.

Figure 2:
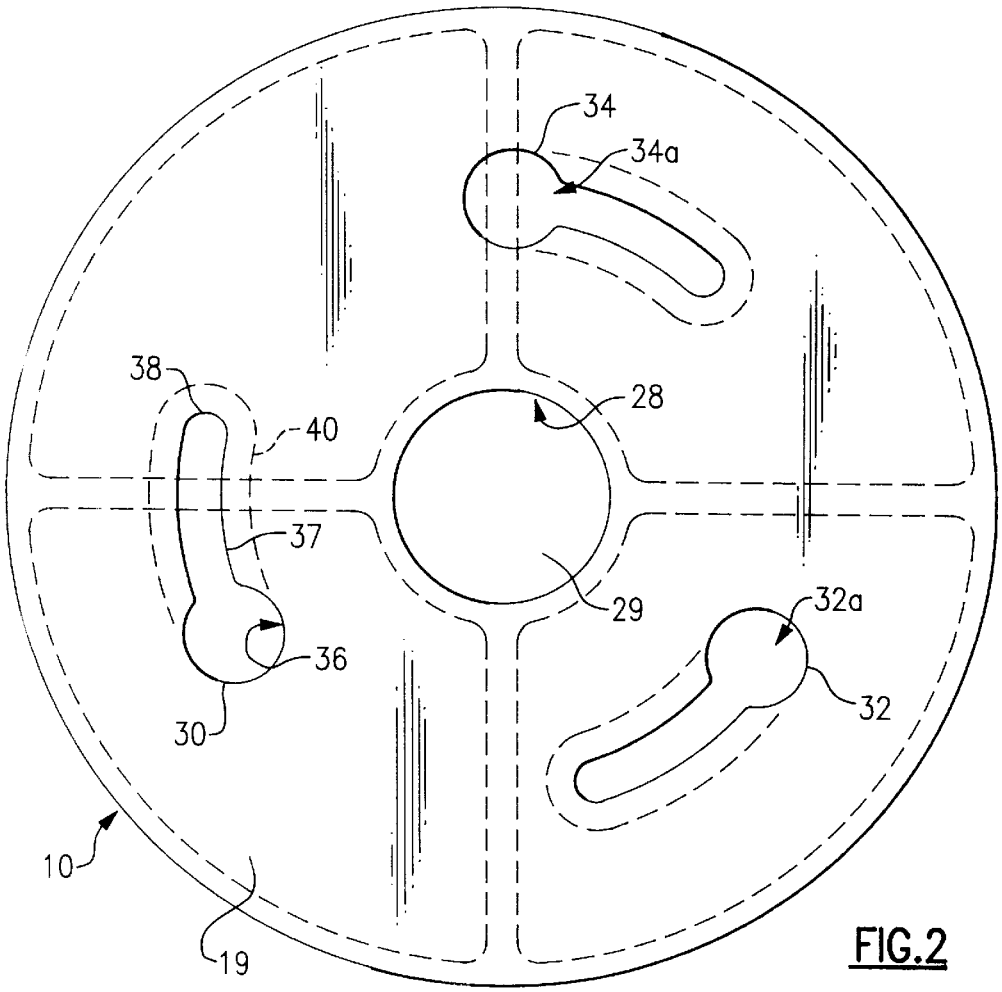
FIG. 2 is a view as shown in FIG. 1 as seen along the lines 2—2 therein.

Referring now to FIG. 2, the third arcuate slot 34 is shown along with the first and second arcuate slots 30, 32. They are each constructed so as to be the same and so the following detail of construction for the first arcuate slot 30 applies to all of them.

The first arcuate slot 30 includes a large circular opening 36 at one end that is open to the top 19. A narrower curved opening 37 extends from the circular opening 36 to its point of termination which is called a first stop 38. An interior slot 40 matches the curvature of the curved opening 37 and is as wide as is the large circular opening 36. The first arcuate slot 30 including the circular opening 36, the narrower curved opening 37 and the interior slot 40 are contained within the top 19.

The second and third arcuate slots 32, 34 are similarly constructed and are spaced equidistant with respect to each other. The first second and third arcuate slots 30, 32, 34 are used to form a mounting system to attach a pedestal support 50 (see FIG. 3) thereto. This type of a mounting system is known as a "bayonet" mount and is described in greater detail hereinafter.

Figure 3:
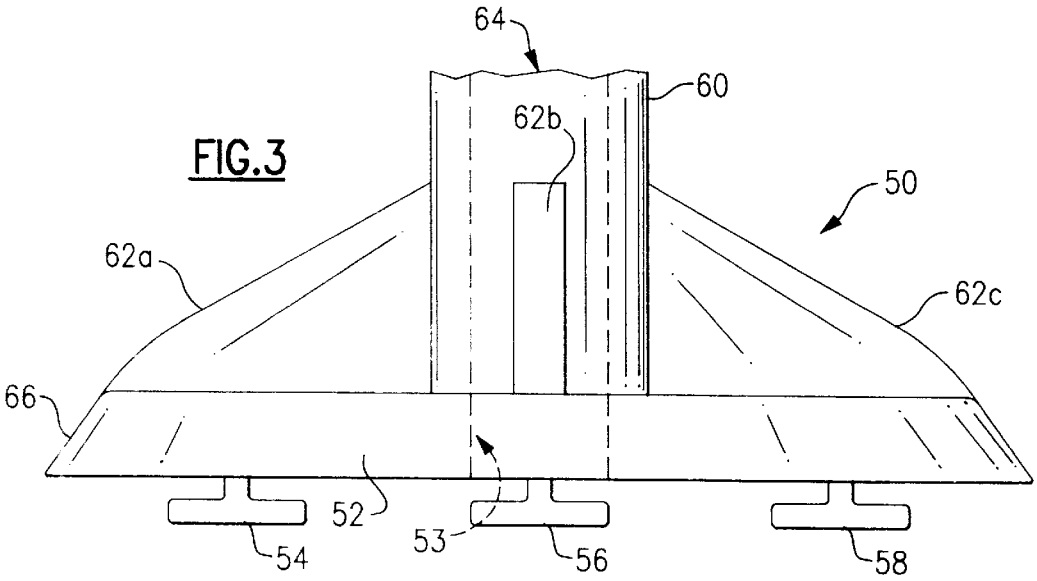
FIG. 3 is a side view of a portion of a pedestal support adapted to cooperate with the base of FIGS. 1 and 2.

Referring now to FIG. 3, the pedestal support 50 includes a circular base plate 52 to which are attached a first T-shaped member 54, a second T-shaped member 56, and a third T-shaped member 58.

An upright pedestal 60 extends upward at a right angle with respect to the plane defined by the base plate 52. A plurality of gusset plates 62 *a,b,c* provide strength to the upright pedestal 60 and are disposed intermediate the upright pedestal 60 and the base plate 52, to which they are each attached.

The upright pedestal 60 includes a hollow interior opening 64 that extends longitudinally along the length of the upright pedestal 60 and which extends through the base plate 52. The base plate 52 includes a tapered edge 66 around the circumference thereof that includes an angled surface so that the base plate 52 has a greater diameter at the bottom and a lesser diameter at the top (closer to the upright pedestal 60). The tapered edge 66 prevents the toes of a user (not shown) from being stubbed by bumping up against what would otherwise be a flat edge.

In use, the pedestal support 50 is attached to the base 10 during use and is removable therefrom as desired. To attach the pedestal support 50 to the base 10, it is held above the base 10 and lowered so that one of the T-shaped members 54, 56, 58 aligns with and enters into the large circular opening 36 of the first arcuate slot 30 and the remaining two of the three T-shaped members 54, 56, 58 align with and enter into a corresponding large circular opening 32*a* of the second arcuate slot 32 and a large circular opening 34*a* of the third arcuate slot 34. The pedestal support 50 is then rotated clockwise to move the T-shaped member (either 54, 56, or 58) along the narrower curved opening 37 until it reaches the first stop 38. The remaining two T-shaped members similarly rotate within the second and the third arcuate slots 32, 34 thereby securing the pedestal support 50 in a position of cooperation adjacent the base 10. This type of a mounting, as mentioned hereinabove, is sometimes called a "bayonet" mount. To remove the pedestal support 50 from the base 10 the procedure is merely reversed by rotating the pedestal support 50 fully counterclockwise and lifting it off of the base 10. When the pedestal support 50 is attached to the base 10 as described hereinabove a tight secure alignment is achieved that positively holds the pedestal support 50 in an upright orientation.

The base 10 and the pedestal support 50 are formed of any desired material. Fiberglass, plastics, composites like graphite, and even certain metals are all candidate materials. The selection of the material used for the base 10 and the pedestal support 50 (as well as all remaining component parts as are discussed in greater detail hereinbelow) is based upon various considerations involving manufacturing costs and ease, aesthetics, durability, and weight to name just a few. Another important consideration is the load that they will be subjected to. For example, a table 118 (FIG. 4) is shown attached to the upright pedestal 60 of the pedestal support 50 and is discussed in greater detail hereinbelow. If the table 100 is large and heavy then a stronger base 10 and pedestal support 50 will be required. This obviously affects the choice of materials including the schedule (thickness of the material) that is selected.

If desired the top 19 of the base 10 can be set slightly below the plane of the surface 14 so that when the base plate 52 is attached to the base 10 the top of the base plate 52 is flush with the plane of the surface 14. In this instance the tapered edge 66 can be eliminated if desired as there is no danger that the toes of the user can impact upon it.

Thus far the construction and the cooperative use of the pedestal support 50 and the base 10 have been discussed.

The pedestal support 50 provides a structure that serves as a platform for attaching numerous accessories that improve the aquatic environment. As such they form the essential building blocks of the underwater attachment system.

Figure 4:
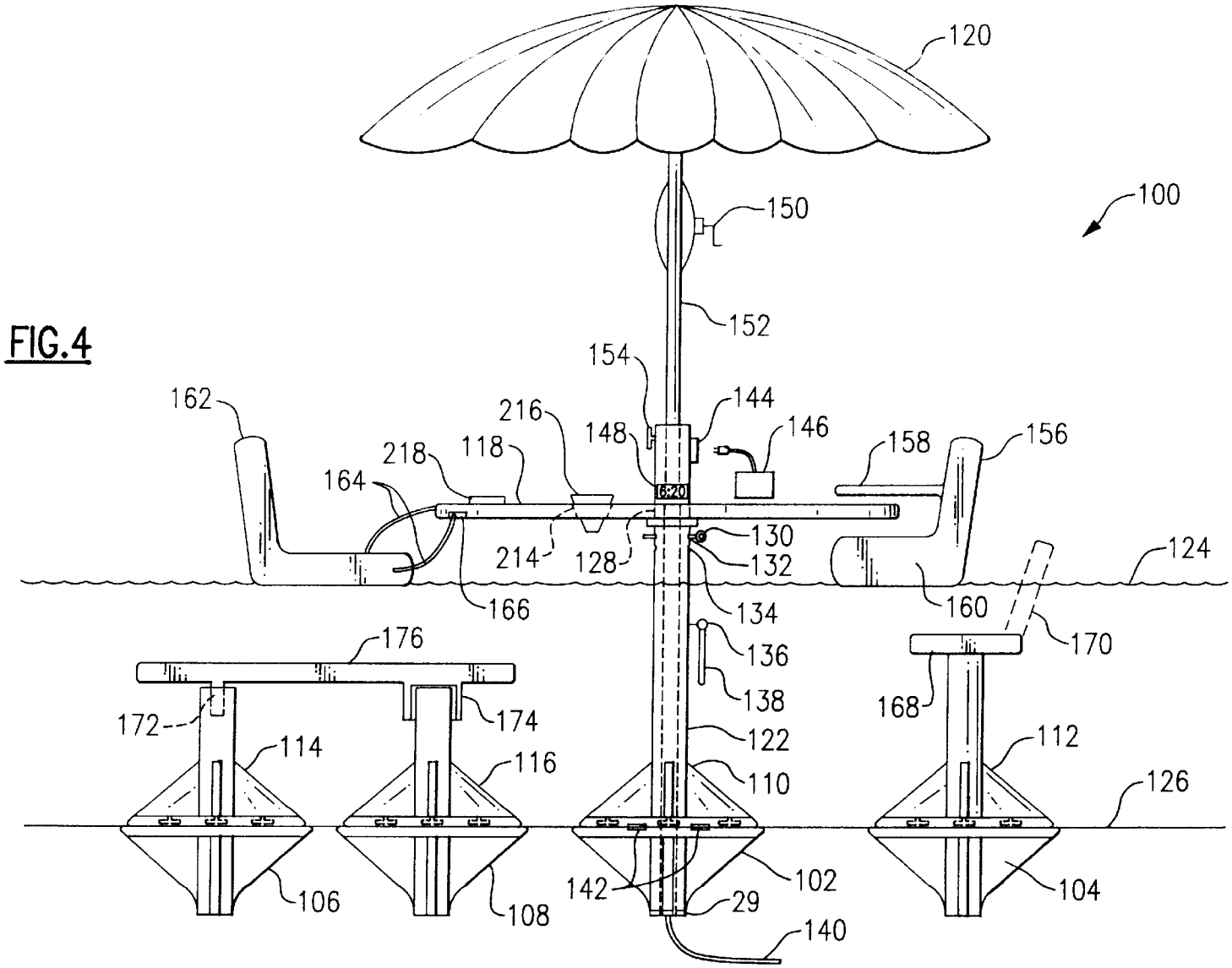
FIG. 4 is a side view of the underwater attachment system at a pool showing several preferred embodiments of the system.

Referring now also to FIG. 4, is shown an underwater attachment system, identified in general by the reference numeral 100 in use at an aquatic environment such as a swimming pool, hot tub, spa, or the like.

A first base 102, a second base 104, a third base 106, and a fourth base 108 secure a first pedestal support 110, a second pedestal support 112, a third pedestal support 114, and a fourth pedestal support 116 thereto respectively. Each of the bases 102–108 are identical and so any of the pedestal supports 110–116 could be placed in any of them.

If for some special reason this were not desired, then certain of the bases could be made of a different size or with a different pattern of T-shaped members (see above) and arcuate slots (see above) that would allow only certain of the pedestal supports 110–116 to cooperate with them. For example, the first pedestal support 110 is used to provide support for a table 118 and an umbrella 120. If it were important to ensure that this particular pedestal support (the first pedestal support 110) could only cooperate with the first base 102, then a modification to both, as described above, is required.

In general, they are all identical so that the vast majority of pedestal supports 110–116 cooperate with the vast majority of bases 102–108, thereby permitting the maximum amount of flexibility in setup and use of the system 100.

The first pedestal support 110 includes a first upright pedestal 122 that extends to a predetermined distance above a water level 124. All of the bases 102–108, including the first base 102, are anchored to the structure (typically formed of gunite, however, not so limited) under a floor level 126 of the pool.

The table 118 may be any desired size or shape, formed of any desired material. It can be attached to the first upright pedestal 122 so that it is an integral part of it, although a preferred embodiment is as shown where the table 118 includes an opening 128 in the center through which the first upright pedestal 122 passes.

A pin 130 passes through a first opening 132 through the first upright pedestal 122 and upon which the table 118 is supported. A second opening 134 is provided to adjust the height of the table 118. Additional openings (not shown) are included, as desired, to further adjust the height of the table 118.

An optional thermometer hook 136 is used to suspend a thermometer 138 in the water. An optional cable 140 is used to supply electrical power to the first base 102 and to a pair of contacts 142 that are attached to the first base 102 and to the first pedestal support 110 so as to cooperate with each other when the first pedestal support 110 is properly attached to the first base 102.

Electrical power is conducted up through the first upright pedestal 122 to an electrical outlet 144 where it is used by an electrical device 146. For safety reasons, low voltage direct current, such as 12 volts DC, is typically used.

It is noted that all of the features disclosed for use with any of the pedestal supports 110–116 are optional devices that are included at the discretion of the manufacturer in accordance with the individual needs of each consumer. As such, the use of electrical power is also optional.

A battery powered digital clock 148 is shown attached to the first upright pedestal 122 above the table 118 that does not require electrical power being supplied thereto through the cable 140. As such any battery operated device or appliance (not shown) may be similarly used with the system 100.

The umbrella 120 includes a crank 150 useful to tilt the umbrella 120 and/or to open and collapse it, both of which are well known in the construction of umbrellas generally.

The umbrella 120 includes a pole 152 that extends down from the top of the umbrella 120 as far as desired. As shown, the pole 152 extends down into and entirely through the hollow interior opening (as exemplified by reference numeral 64 in FIG. 3) of the first upright pedestal 122, passing through an aperture (as exemplified by reference numeral 53 in FIG. 3) in the circular base plate (as exemplified by reference numeral 52 in FIG. 3) and through the hollow interior (as exemplified by reference numeral 28 in FIG. 2) of the center cylindrical member (as exemplified by reference numeral 26 in FIG. 2) of the first base 102 until contact with the bottom plate 29 occurs.

Having the pole 152 fit into the first upright pedestal 122 provides two benefits. The first, and perhaps the most important, is that the extra length of the pole 152 allows for the umbrella 120 to be positioned at whatever height (elevation) is desired.

The umbrella 120 is maintained at the desired elevation by tightening a wing-nut 154 that passes through a threaded opening disposed on one side of the upright pedestal 122 until it (the wing-nut 154) bears against the pole 152 and secures it in position. To remove the umbrella 120, the wing-nut 154 is loosened and the pole 152 is lifted to remove it from the first upright pedestal 122.

Secondly, the pole 152 supplies additional strength to the first pedestal support 110 assembly when it is disposed therein. When it is allowed to pass all the way to the first base 102, maximum support for the umbrella 120 is provided. This is an important consideration because when, for example, the wind blows there is considerable side-loading of the umbrella and therefore of the first pedestal support 110 assembly that occurs.

Attached to an edge of the table 118 is an infant seat 156 that includes a pair of arms 158 that are disposed on the top of the plane of the table 118 and a pair of sides 160 that are disposed under the table 118 and which, together, maintain the infant seat 156 in a position of cooperation with the table 18. An infant (not shown) is then placed in or removed from the infant seat from above. This provides a way to safely secure the infant in position in an aquatic environment thereby alleviating a certain amount of risk and attention that would otherwise have to be paid to the infant.

A floating chair 162 is tethered to the table 118 by a pair of tethers 164, each of which are attached to the table 118 by a hook and loop fastener 166 (as is sold under the tradename VELCRO). The floating chair 162 is intended to represent any device that floats including floating lounge chairs and floating types of aquatic toys. The benefit thus provided is that the system 100 functions as an aquatic center of interest where users can congregate to enjoy he aquatic environment.

A stool 168 is attached to the top of the second pedestal support 112 and provides a seat that is disposed under the water level 124. A back rest 170 is shown in dashed lines to indicate a possible modification to the stool 168. When the back rest 170 is included with the stool 168 it is then more accurately referred to as being a chair. The second pedestal support 112 is clearly adapted to support either the stool 168 or the chair, as desired.

The third base 106 is disposed a predetermined distance apart from the fourth base 108 so that the third and fourth pedestal supports 114, 116 are properly positioned to receive a pin 172 that enters into the top of the third pedestal support 114 and a sleeve 174 that passes over the top of the fourth pedestal support 116. The pin 172 and the sleeve 174 are attached to the bottom of a bench 176. The bench 176 extends from the third pedestal support 114 to the fourth pedestal support 116 and, if desired, a small amount past them.

If desired a second pin (not shown) or a second sleeve (not shown) could be used as well, however this does not provide any method to ensure that the bench 176 is properly attached. If the bench 176 includes a curvature that matches that of, the table 118 for example, it may be desirable to guide a user in its proper installation which is quite simple. The bench 176 is merely oriented above the third and fourth pedestal supports 114, 116 and lowered into proper position so that the pin 172 enters into the third pedestal support 114 and the sleeve 174 passes over the fourth pedestal support 116. This of course can occur only after the third and fourth pedestal supports have been properly attached to their respective third and fourth bases 106, 108. Removal of the bench 176 is merely a reversal of the procedures described.

Figure 5:
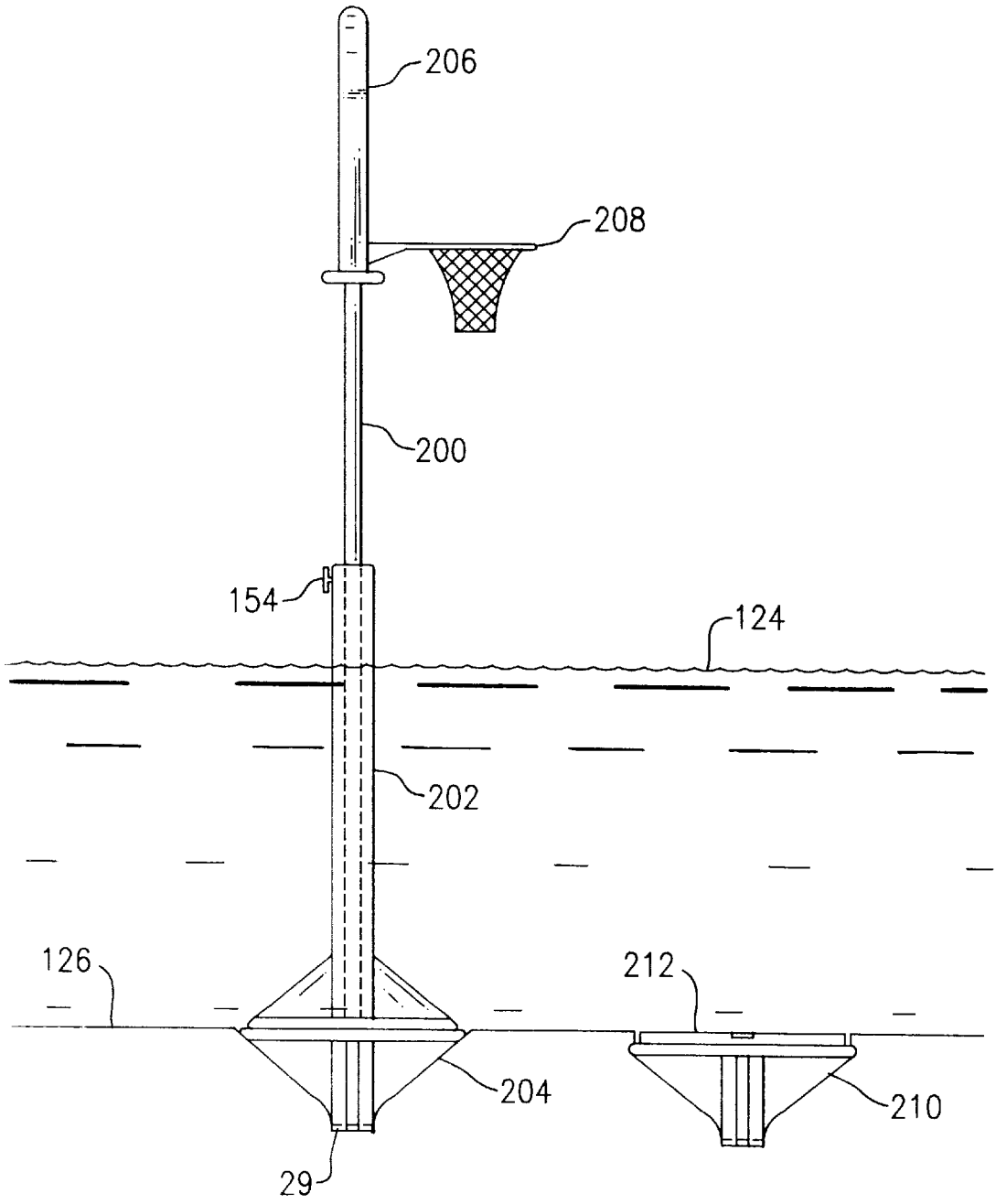
FIG. 5 is a side view of a recreational use of the system.

Referring now also to FIG. 5, a second pole 200 is shown entering into a fifth pedestal support assembly 202, passing down into a fifth base 204 and extending down through the bottom of the fifth base 204 and to the bottom plate 29. The second pole 200 extends all the way to the bottom plate 29 to achieve maximum strength and support.

A backboard 206 is attached to the top of the second pole 200 to which a basketball rim and hoop 208 are attached. The table 118, umbrella 120, and pole 152 (of FIG. 4) can be removed from the first pedestal assembly 110 (of FIG. 4) and the second pole 200 can be substituted in their place.

This would change the aquatic area from that of primarily a lounging, eating, and shaded area into a sport-recreational area. If the second pole 200 were to extend below the level of the first base 102 (of FIG. 4) the cable 140 would have to be routed so as not to interfere with the second pole 200, if it were also included.

A sixth base 210 is shown with the plane of its top being disposed parallel to and slightly below the plane of the floor level 126 and a cover 212 attached thereto, the top of which is equal to the plane of the floor level 126. This type of installation for the sixth base 210 is preferred and may be used for all embodiments as described hereinabove. The advantage is that when any of the pedestal support assemblies is removed and the cover 212 is added, a smooth surface even with the floor level 126 results. This can prevent a user (not shown) from stubbing his or her toe (not shown). The cover 212 twists on and off of the sixth base 210 as does the fifth pedestal support assembly 202.

Of course, any number of additional bases (not shown) may be positioned where desired (such as around the table 118) to provide for as many stools 168, chairs, or benches 176 as desired and where desired. Similarly, any number and type of modifications can be made to provide a modified pole (not shown) or modified pedestal support assembly to satisfy any requirement. For example, a pair of modified poles could be used to support a volley ball net (not shown). The variety of possible uses for the system 100 are unlimited.

As another example, a tapered opening 214 (FIG. 4) is provided through the table 118 to permit placing a cup 216 therein. Similar improvements reflect the quality of components and the market they are intended to serve. A high end application of the table 118 would include a tiled surface 218 of any size, pattern, or location, as desired. This might be done in such a manner so as to match (color coordinate) the appearance of the table 118 with the border tile work (not shown) of the pool or hot tub in which it is placed.

Another example of a possible modification to the cable 140 would be the addition of fiber optic cables therein to act as a high-speed optical interface. A portable computer (not shown) when used on the table 118 could benefit from such an interface. Certainly the user would enjoy working at the "office of the future" while at home and when sitting on the stool 168 under the shade of the umbrella 120.

Figure 6:
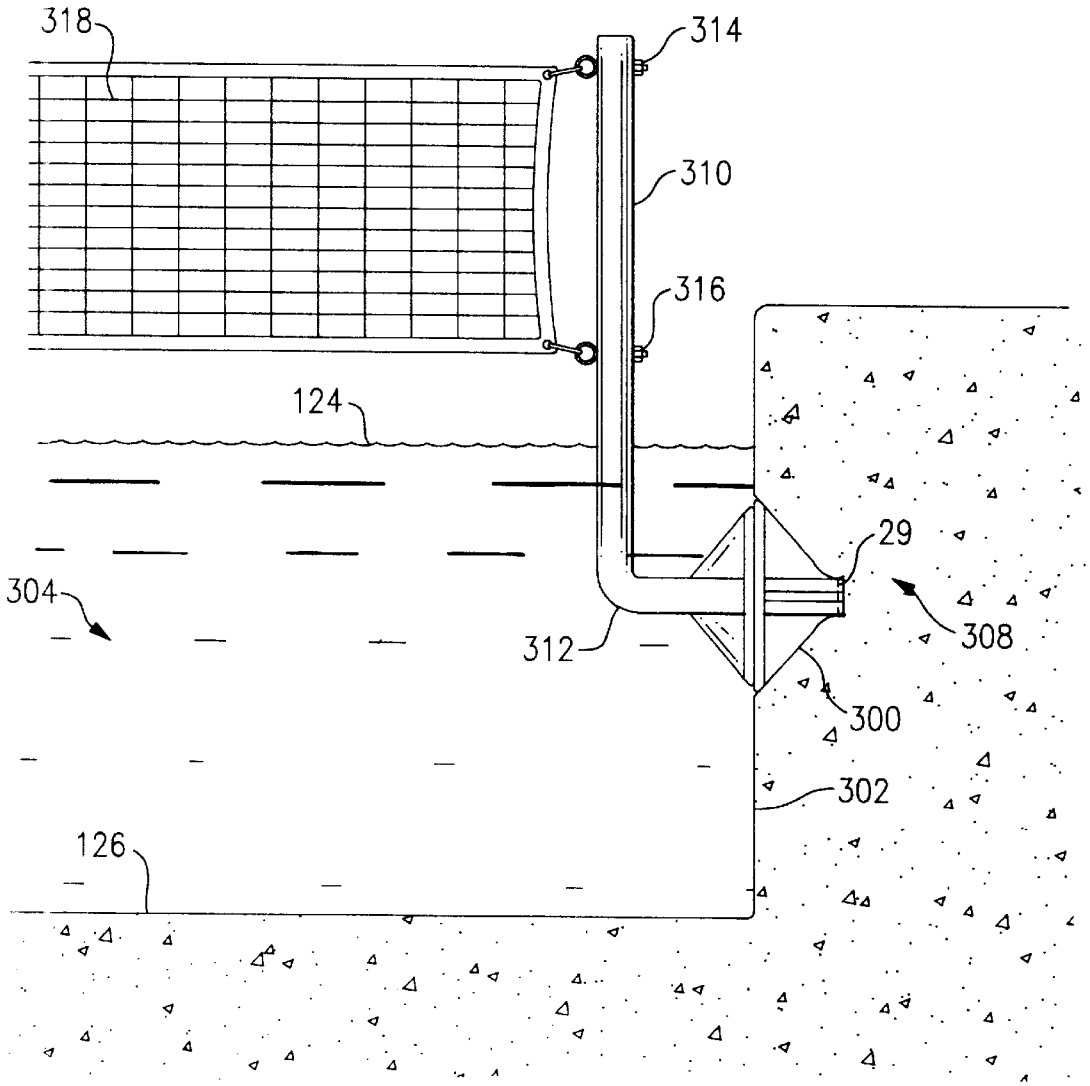
FIG. 6 is a side view of the underwater attachment system with a modified base attached to the side wall of a pool and a modified pedestal support attached thereto.

Referring now to FIG. 6, is shown a modified base 300 attached to a side wall 302 of a swimming pool, identified in general by the reference numeral 304. The modified base 300 is generally constructed identical with that of the base 10, the first base 102, the second base 104, the third base 106, the fourth base 108, and the fifth base 204 and is, instead, installed on the side wall 302 of the pool 304.

A modified pedestal support 310 is formed similar to those types previously described except that it includes a 90 degree bend 312 and, as shown, a pair of eye bolts 314, 316. The eye bolts 314, 316 hold the top and bottom of one side of a volley ball net 318. The opposite side (not shown) of the net 318 is similarly supported by a second modified pedestal support (not shown) attached to a second modified base (not shown).

In use, when the modified pedestal support 310 is installed in the modified base 300 it is installed at a slight angle so as to properly align the T-shaped members (not shown) with the large circular openings of the arcuate slots (not shown). The modified pedestal support 310 is then rotated so the T-shaped members reach the stops (not shown). At this time a terminal portion of the modified pedestal support 310 extends vertically above the water level 124. This allows use of the system in the side wall 302 of the pool 304, hot tub, spa, and similar structure.

Of course any number of devices (not shown) are anticipated for use with the modified pedestal support including stools, benches, umbrellas, ladders (to climb in and out of the pool 304), basketball hoops and backboards, and the like.

The invention has been shown, described, and illustrated in substantial detail with reference to the presently preferred embodiment. It will be understood by those skilled in this art that other and further changes and modifications may be made without departing from the spirit and scope of the invention which is defined by the claims appended hereto.

What is claimed is:

1. An underwater attachment system for use in a swimming pool or spa, comprising:

(a) a base adapted to be attached to a surface of said swimming pool or spa, said base adapted to be disposed under water; and (b) a pedestal support including means for attaching said pedestal support to said base and for removing said pedestal support from said base wherein said means for attaching includes a twist-on and twist-off mechanism wherein said twist-on and twist-off mechanism is adapted to permit rotation of said pedestal support radially and to prevent a change axially from occurring when said pedestal support is inserted to said base and when said pedestal support is removed from said base and wherein said pedestal support is disposed in substantially a vertical orientation and extending in a direction generally away from said base.

2. The system of claim 1 wherein said twist-on and twist-off mechanism includes a bayonet type of mechanism.

3. The system of claim 1 wherein said pedestal support includes a table.

4. The system of claim 3 wherein said table includes means for adjusting its position with respect to said pedestal support.

5. The system of claim 3 including an infant chair, said infant chair attachable to and removable apart from said table.

6. The system of claim 3 including means for attaching a device adapted to float to said table.

7. The system of claim 6 wherein said means for attaching includes the use of a hook and loop fastener.

8. The system of claim 3 wherein said table includes a cup holder.

9. The system of claim 1 wherein said pedestal support includes an umbrella.

10. The system of claim 9 including means for adjusting the position of said umbrella with respect to said pedestal support and wherein said umbrella includes a pole and said pole is disposed in an opening provided in said pedestal support along a longitudinal length thereof and wherein said pole is adapted to move longitudinally therein and wherein said means for adjusting is adapted to secure said pole along said longitudinal length.

11. The system of claim 1 wherein said pedestal support includes means for providing a source of electrical power.

12. The system of claim 1 wherein said pedestal support includes means for securing a thermometer thereto.

13. The system of claim 1 wherein said pedestal support includes a digital clock attached thereto.

14. The system of claim 1 wherein said pedestal support includes a stool attached thereto.

15. The system of claim 1 wherein said pedestal support includes a chair attached thereto.

16. The system of claim 1 including a plurality of pedestal supports attached to a plurality of bases and a bench detachably-attachable to said plurality of pedestal supports.

17. The system of claim 1 including a pole adapted for use with said pedestal support, said pole including means attached thereto useful for playing a game.

18. The system of claim 17 wherein said pole includes a backboard and a hoop attached thereto adapted for playing said game while a player is disposed in the water.

19. The system of claim 1 wherein said base includes means for further securing said base to said structure.

20. The system of claim 1 wherein said base is attached to a bottom of said structure.

21. The system of claim 1 wherein said base is attached to a side of said structure.

22. The system of claim 21 wherein said pedestal support includes a modified pedestal support, said modified pedestal support including a portion that is disposed in substantially a horizontal direction and which includes a radius of approximately 90 degrees and a terminal portion that is disposed in substantially a vertical orientation and which extends in generally an upward direction.

* * * * *